US010023448B2

(12) United States Patent
Lewis et al.

(10) Patent No.: US 10,023,448 B2
(45) Date of Patent: Jul. 17, 2018

(54) LIFT TRUCK WITH MAST

(71) Applicant: The Raymond Corporation, Greene, NY (US)

(72) Inventors: Robert Lewis, Chenango Bridge, NY (US); John A. West, Vestal, NY (US)

(73) Assignee: The Raymond Corporation, Greene, NY (US)

( * ) Notice: Subject to any disclaimer, the term of this patent is extended or adjusted under 35 U.S.C. 154(b) by 0 days.

(21) Appl. No.: 14/832,078

(22) Filed: Aug. 21, 2015

(65) Prior Publication Data

US 2015/0360921 A1 Dec. 17, 2015

Related U.S. Application Data

(63) Continuation of application No. 12/941,647, filed on Nov. 8, 2010, now abandoned, which is a continuation of application No. 12/106,802, filed on Apr. 21, 2008, now Pat. No. 7,984,793, which is a continuation of application No. 11/467,754, filed on Aug. 28, 2006, now Pat. No. 7,398,859, which is a continuation of application No. 10/634,377, filed on Aug. 5, 2003, now Pat. No. 7,096,999.

(51) Int. Cl.

| | |
|---|---|
| ***B66F 9/22*** | (2006.01) |
| ***B66F 9/08*** | (2006.01) |
| ***B66F 9/07*** | (2006.01) |

(52) U.S. Cl.

CPC ..... *B66F 9/08* (2013.01); *B66F 9/07* (2013.01); *B66F 9/22* (2013.01)

(58) Field of Classification Search

CPC ..... B66F 9/22; B66F 9/08; B66F 9/07

See application file for complete search history.

(56) References Cited

FOREIGN PATENT DOCUMENTS

EP 0367545 A1 * 5/1990 ..... B66F 9/08

* cited by examiner

*Primary Examiner* — William A. Rivera
*Assistant Examiner* — Stefan Kruer
(74) *Attorney, Agent, or Firm* — Quarles & Brady LLP

(57) ABSTRACT

A lift truck includes an operator compartment and a pair of forks extending away from said operator compartment in a forward direction. A pair of mast columns are interposed between the operator compartment and the forks. Components mounted on at least one of the mast columns are arranged to fall within a viewing shadow so as not to obstruct the operator's field of view.

19 Claims, 8 Drawing Sheets

LIFT TRUCK WITH MAST

CROSS-REFERENCE TO RELATED APPLICATIONS

This is a continuation of U.S. patent application Ser. No. 12/941,647, filed Nov. 8, 2010, which is a continuation of U.S. patent application Ser. No. 12/106,802, filed Apr. 21, 2008, now U.S. Pat. No. 7,984,793, which is a continuation of U.S. patent application Ser. No. 11/467,754, filed Aug. 28, 2006, now U.S. Pat. No. 7,398,859, which is a continuation of U.S. patent application Ser. No. 10/634,377 filed Aug. 5, 2003, now U.S. Pat. No. 7,096,999, all of which are fully incorporated herein by reference.

STATEMENT REGARDING FEDERALLY SPONSORED RESEARCH OR DEVELOPMENT

Not applicable.

FIELD OF INVENTION

The field of the invention is industrial lift trucks, and particularly lift trucks with telescopic masts.

BACKGROUND OF THE INVENTION

A lift truck typically is a battery powered vehicle having an operator compartment with controls that enable the operator to drive the truck and to hoist materials and carry them quickly throughout a factory or warehouse. An upright telescopic mast is attached to the forward end of the truck and with a carriage, or forks, supporting materials can be hoisted by extending the telescopic mast upward.

An exemplary lift truck is shown in FIGS. 1 and 2. It includes an operator compartment 10, a battery 11 and outriggers, or baselegs, 12A and B. A three section, telescopic mast 20 attaches to the front of the truck and includes a base section 21 and two telescopic sections 22 and 23. As shown best in FIG. 2, the lower telescopic section 22 (referred to in the art as the "outer" telescopic section) is nested within the base section 21 and the higher telescopic section 23 (referred to in the art as the "inner" telescopic section) is nested inward of the outer telescopic section 22.

A fork carriage 13 is slidable mounted to the inner telescopic section 23 and it is moved up and down thereon by carriage free lift cylinders 13A and B via chains 13C which pass over pulleys 13D. The outer telescopic section 22 is moved relative to the base section 21 by a main lift cylinder 22A located midway between the left and right mast sections. Lift chains (not shown in FIGS. 1 and 2) fastened to the base section 21, extending over pulleys at the top of the outer telescopic section 22, and fastened to the bottom end of the inner telescopic section 23 provide a simultaneous and coordinated movement of the inner telescopic section 23 relative to the outer telescopic section 22. Operation of the main lift cylinder 22A using controls in the operator compartment 10 may thus extend or contract the two telescopic sections 22 and 23. Operation of the carriage free lift cylinders 13A and B from the operator compartment 10 also controls the precise height of the fork carriage 13.

These mast elements plus the associated hydraulic hoses and electrical cable provide obstructions which limit the operator's field of view when looking forward towards the forks from the operator compartment 10. This is particularly true when the mast is lowered and all the cylinders 22A, 13A and 13B are disposed directly in front of the operator.

Many efforts have been made to improve the operators' field of view when looking forward through the mast. These include shortening the main lift cylinders as disclosed in U.S. Pat. Nos. 4,191,276 and 4,261,438 so that it does not obstruct view when the mast is lowered, shifting the location of the main lift cylinder to one side as disclosed in U.S. Pat. No. 4,355,703; shifting the location of the single main lift cylinder to one side and shifting a single carriage free lift cylinder to the other side as disclosed in U.S. Pat. No. 4,506,764; and shifting the location of the two carriage free lift cylinders to locations nearer the mast uprights to increase visibility as described in U.S. Pat. Nos. 4,369,861; 4,365,693; 4,030,568 and 4,441,585. Yet another approach disclosed in U.S. Pat. No. 4,585,093 is to locate the two carriage free lift cylinders substantially behind the mast uprights and provide two main lift cylinders which are also behind the respective mast uprights. This is carried one step further in U.S. Pat. No. 6,505,710 in which the two main lift cylinders are formed into the base section of the mast.

A significant constraint on the design of a lift truck mast structure is its fore to aft dimension. The length of a lift truck is a very important characteristic, since turning radius is directly related to length. The productivity of a truck and operator is directly related to the turning radius since in the tight confines of factories and warehouses a smaller turning radius translates to less back-and-forth jockeying of the truck. The elimination of one or more inches in the length of a truck therefore has significant economic significance.

SUMMARY OF THE INVENTION

The present invention is a lift truck in which the mast elements and associated lift elements are arranged to maximize the operator's field of view when looking forward from the operator compartment. In a preferred embodiment, the lift truck includes an operator compartment and a pair of forks extending away from said operator compartment in a forward direction. A pair of mast columns are interposed between the operator compartment and the forks. Components mounted on at least one of the mast columns are arranged to fall within a viewing shadow so as not to obstruct the operator's field of view.

DETAILED DESCRIPTION OF THE PREFERRED EMBODIMENT

Figure 1:
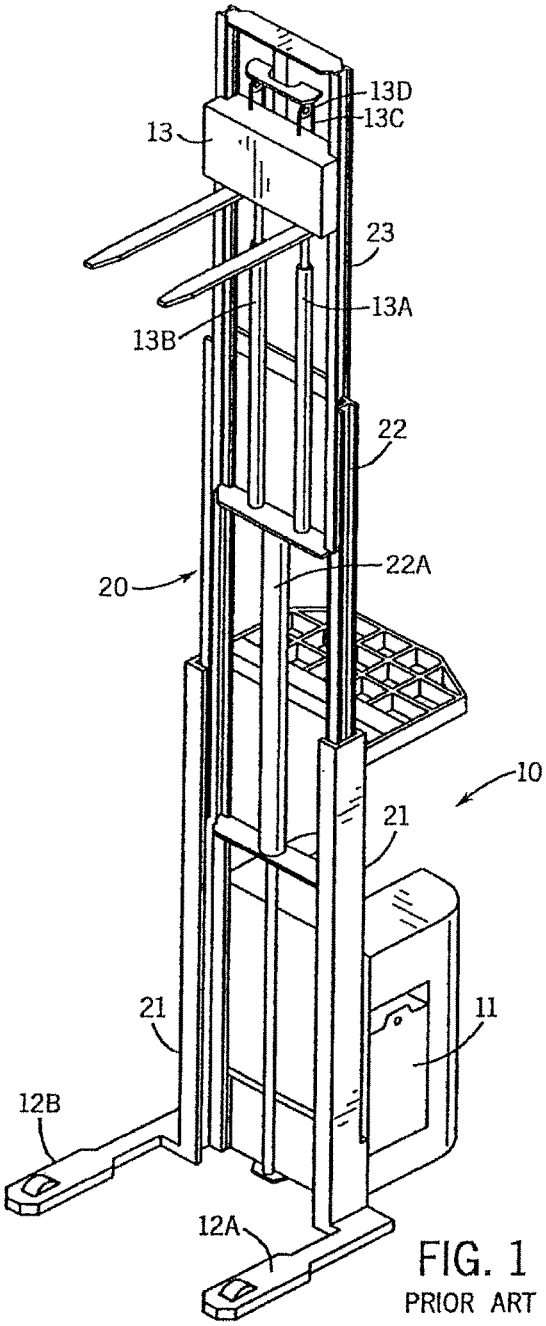
FIG. 1 PRIOR ART
FIG. 1 is a perspective view of a typical prior art lift truck.
Figure 2:
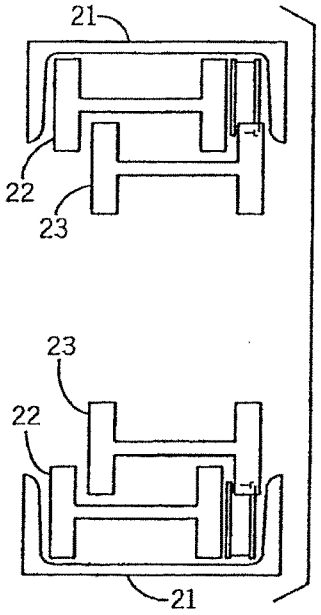
FIG. 2 PRIOR ART
FIG. 2 is a cross-sectional view through the mast of the prior art lift truck in FIG. 1.
Figure 3:
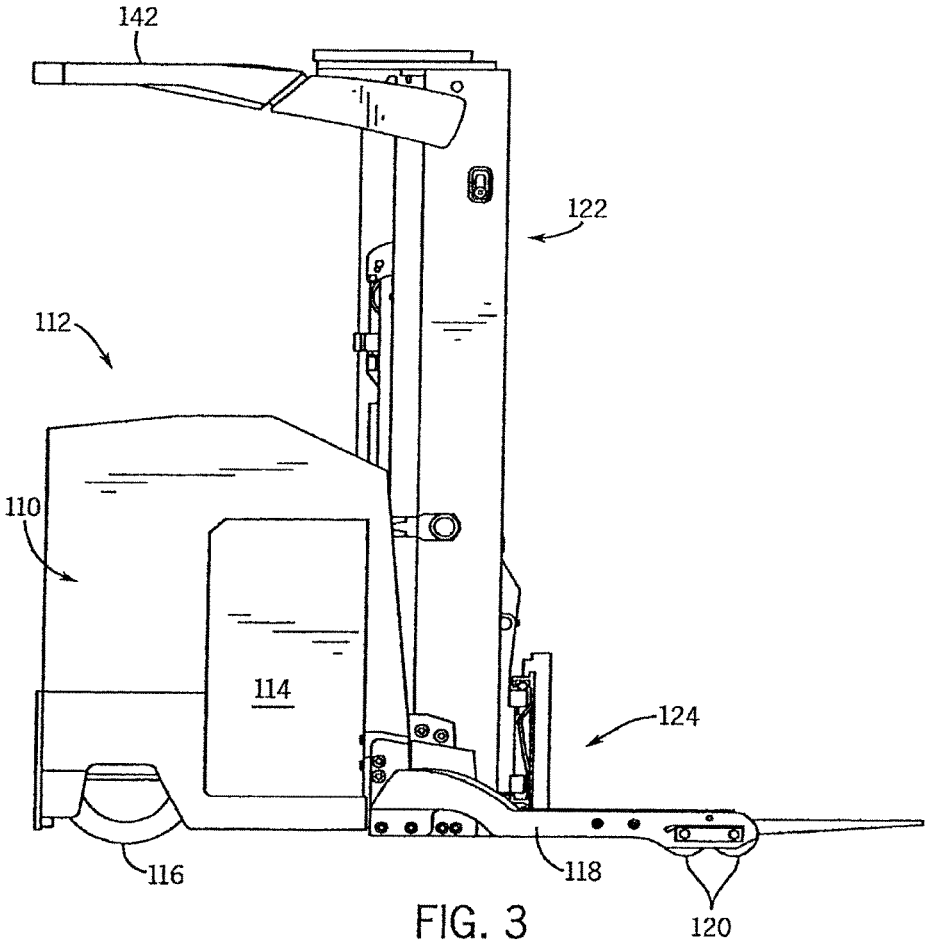
FIG. 3 is a side elevation view of a lift truck which employs the present invention.

Referring particularly to FIG. 3, a lift truck which employs a preferred embodiment of the invention includes a power unit 110 having an operator's compartment 112 located to the rear and a battery compartment 114 located at the forward end. The battery supplies power to a traction motor drive (not shown) which rotates a steerable drive wheel 116 to propel and steer the lift truck. A pair of laterally spaced baselegs 118 indirectly connect to, and extend forward from the power unit 110, and each baseleg includes wheels 120 which support the truck.

A mast 122 connects to the front end of the power unit 110 and extends vertically upward therefrom. The mast 122 supports a fork carriage 124 which can be elevated to different heights as will be described in detail below. The mast 122 is comprised of three telescopic sections which are shown best in FIGS. 4A and 4B. These include a base section 126, an outer telescopic section 128, and an inner telescopic section 130. Rollers mounted to the sections 126, 128 and 130 enable those sections to slide with respect to each other to allow the mast to be raised and lowered. These mast elements form two spaced mast columns which obstruct the operator's view when looking forward from the operator compartment. It is an objective of this design to reduce the profile of these mast columns and the associated mast elements to maximize the operator's forward field of view.

Figures 5A, 5B, 5C:
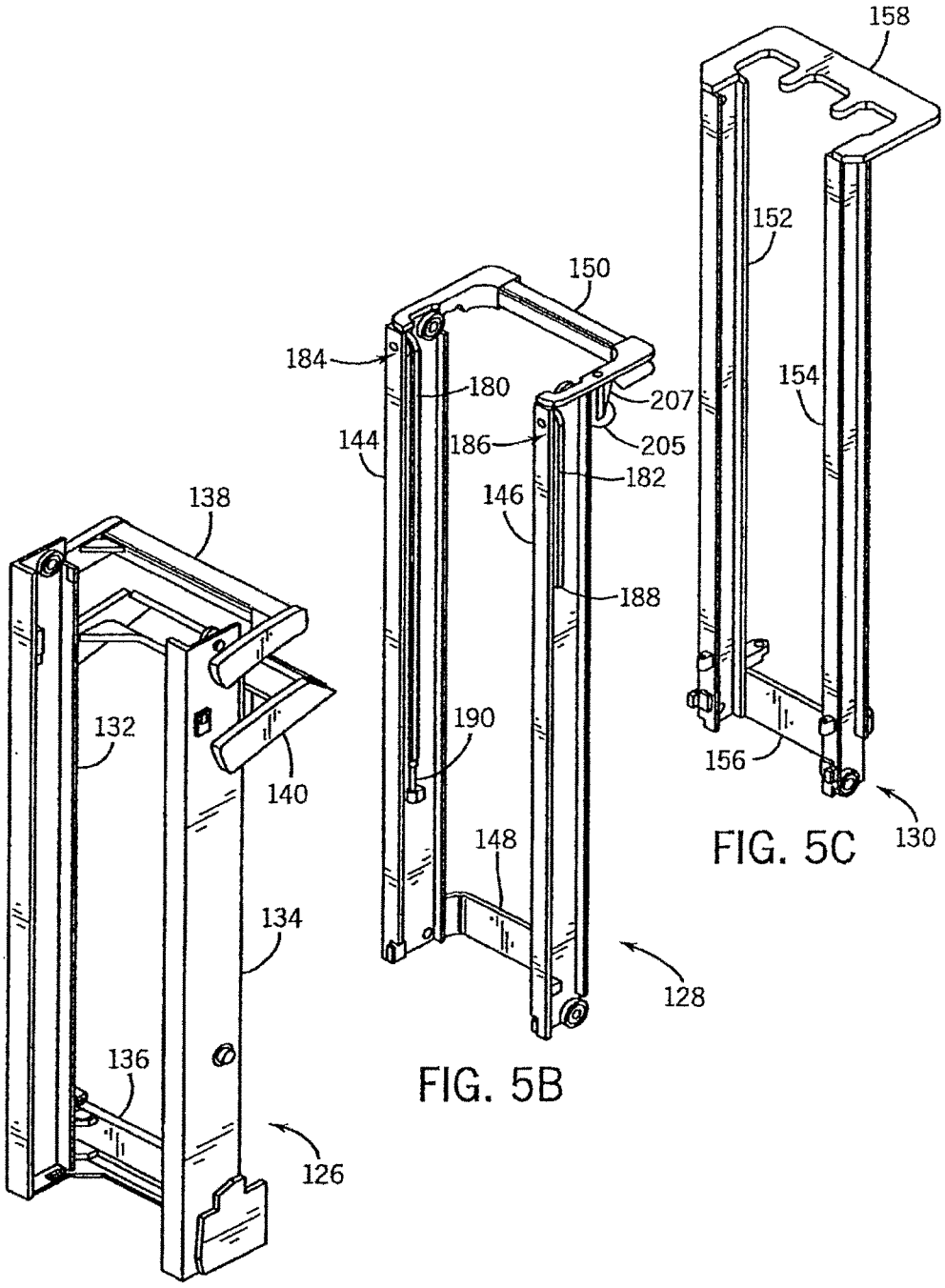
FIGS. 5A, 5B and 5C are perspective views of the respective base section, outer telescopic section and inner telescopic section of the mast structure of FIG. 4.

As shown best in FIG. 5A, the base section 126 is comprised of a pair of spaced, base rail members 132 and 134 connected together at their bottom ends by a base crosstie 136 and at their upper ends by a pair of crossties 138 and 140. The crossties 138 and 140 include a set of louvers which provide the desired structural rigidity and which are oriented at an angle which minimizes obstruction of the operator's view. The crosstie 140 also serves to support a protective guard 142 (see FIG. 3) above the operator. The base crosstie 136 attaches to the front of the power unit 110 and serves as a means for fastening the mast structure to the power unit 110.

Referring particularly to FIG. 5B, the outer telescopic 128 is comprised of a pair of spaced, upright mid rails 144 and 146 connected at their lower ends by a lower crosstie 148. An upper crosstie 150 extends rearward from the upper ends of the mid rails 144 and 146 and then laterally across the space between the mid rails 144 and 146 to maintain their parallel alignment. The rearward extending portions of the crosstie 150 also provides a connection point for a pair of main lift cylinders to be described in more detail below.

Figure 8:
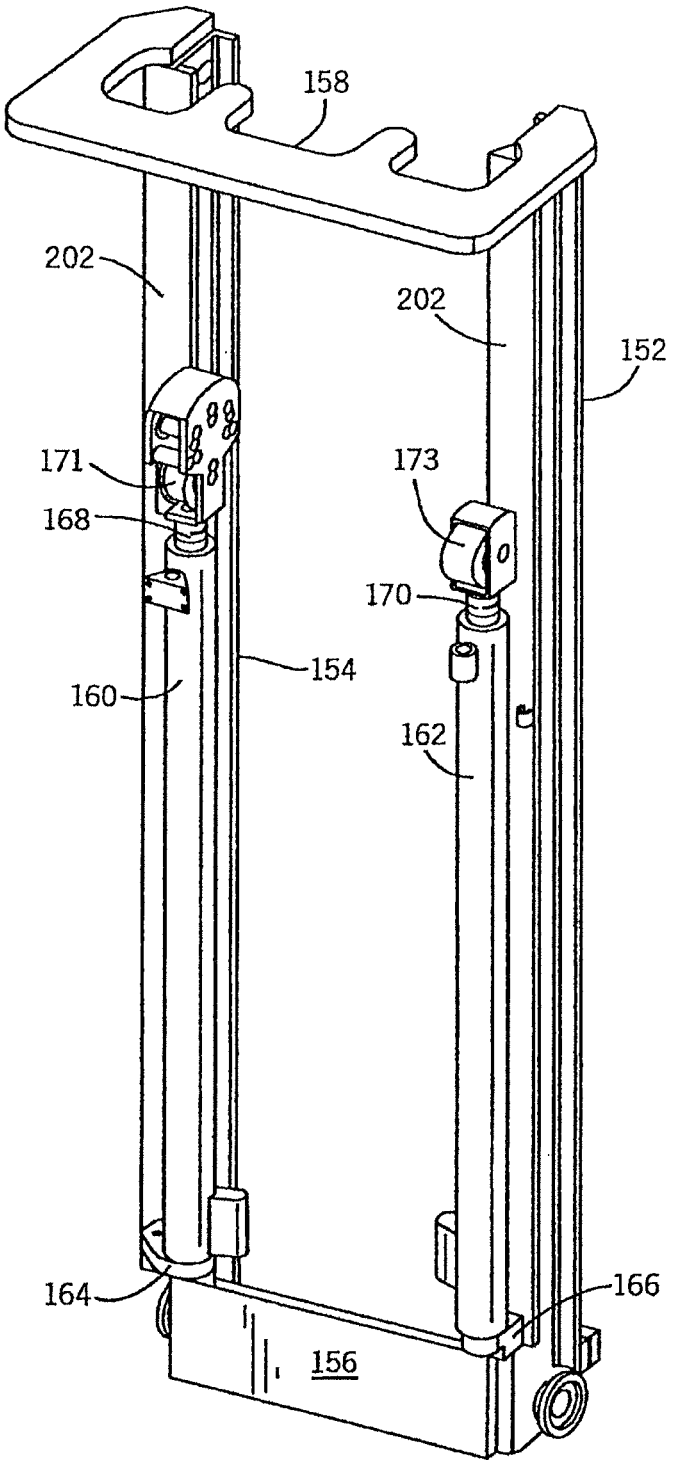
FIG. 8 is a perspective view of the inner telescopic section with attached free lift cylinders.

Referring particularly to FIGS. 5C and 8, the inner telescopic section 130 is comprised of a pair of spaced, upright top rails 152 and 154 connected at their lower ends by a lower crosstie 156 and connected at their upper ends by an upper crosstie 158. Upper crosstie 158 extends rearward and presents a horizontal platform having openings therein which enable the upper ends of a pair of free lift cylinders 160 and 162 to extend. The lower ends of free lift cylinders 160 and 162 mount to ears 164 and 166 that extend rearward from the top rails 154 and 152 adjacent the lower crosstie 156. The upper cylinder ends connect to a rear flange 202 of the top rails 152 and 154 near their top ends. As will be described in detail below, the free lift cylinders 160 and 162 are hydraulically operated in response to commands from the operator to extend and retract rods 168 and 170 to raise and lower the fork carriage 124 that is slidably mounted to the top rails 152 and 154.

Figure 9:
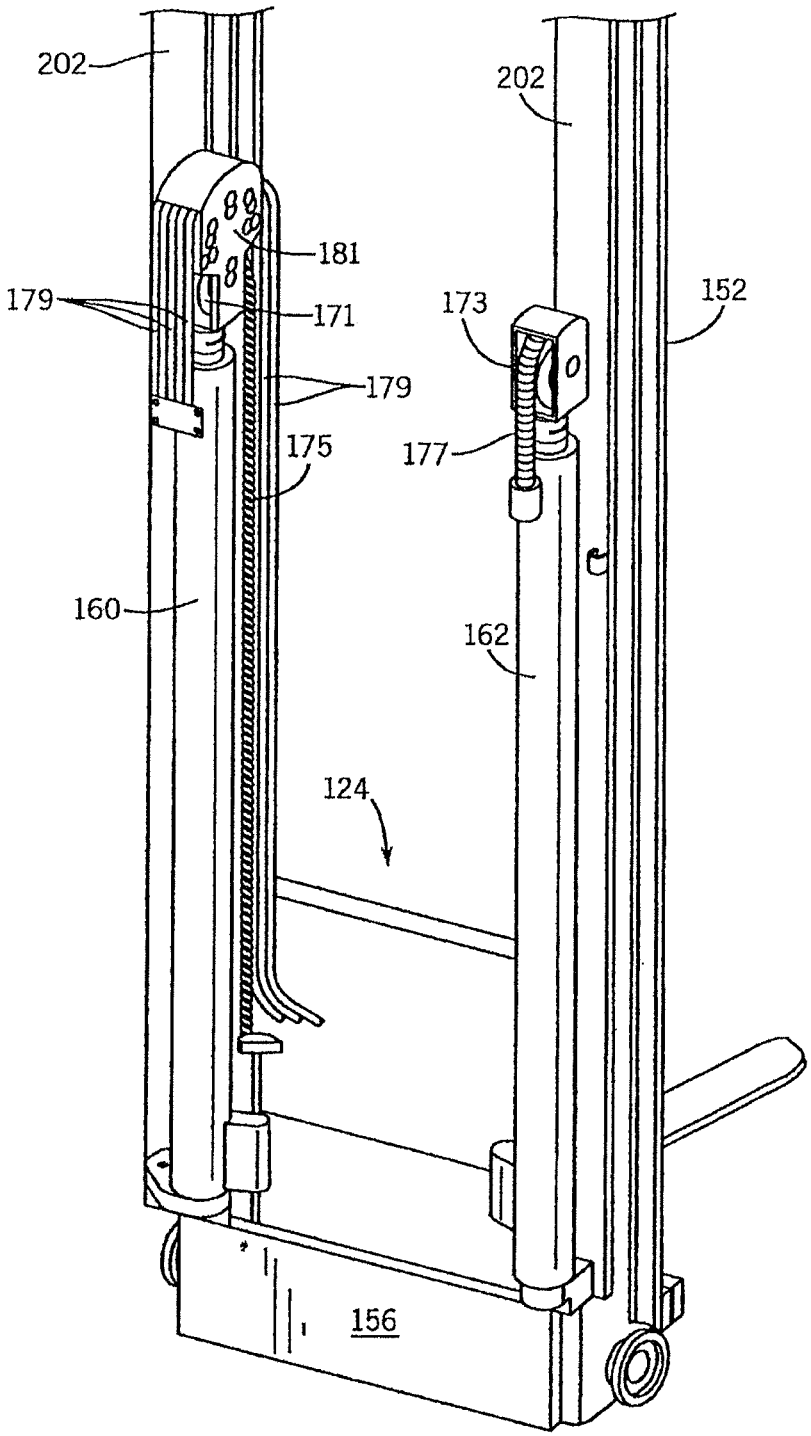
FIG. 9 is a partial perspective view of the inner telescopic section with slidably mounted fork carriage.

Referring particularly to FIGS. 8 and 9, free lift chain pulleys 171 and 173 are mounted to the top ends of the respective free lift cylinder rods 168 and 170. Free lift chains 175 and 177 extend over the respective pulleys 171 and 173 and one end of each chain is anchored to the rear side of respective free lift cylinders 160 and 162. The other end of each free lift chain drapes down the front side of their respective cylinders 160 and 162 and attaches to the back of the fork carriage 124. When the rods 168 and 170 of the free lift cylinders 160 and 162 are extended, the pulleys 171 and 173 move upward and the forward ends of the chains 175 and 177 are raised a corresponding amount to slide the fork carriage 124 upward on the inner telescopic section 130.

As shown in FIG. 9, the fork carriage 124 requires hydraulic hoses and cable 179 to operate a reach and retract mechanism mounted therein. These hoses and cable 179 extend over a hose pulley 181 which is mounted above the chain pulley 171 on the left free lift cylinder 160. One end of each hose and cable 179 is anchored on the rear side of the free lift cylinders 160 and the other end connects to the hydraulic and electrical circuits in the fork carriage 124.

Figure 4A:
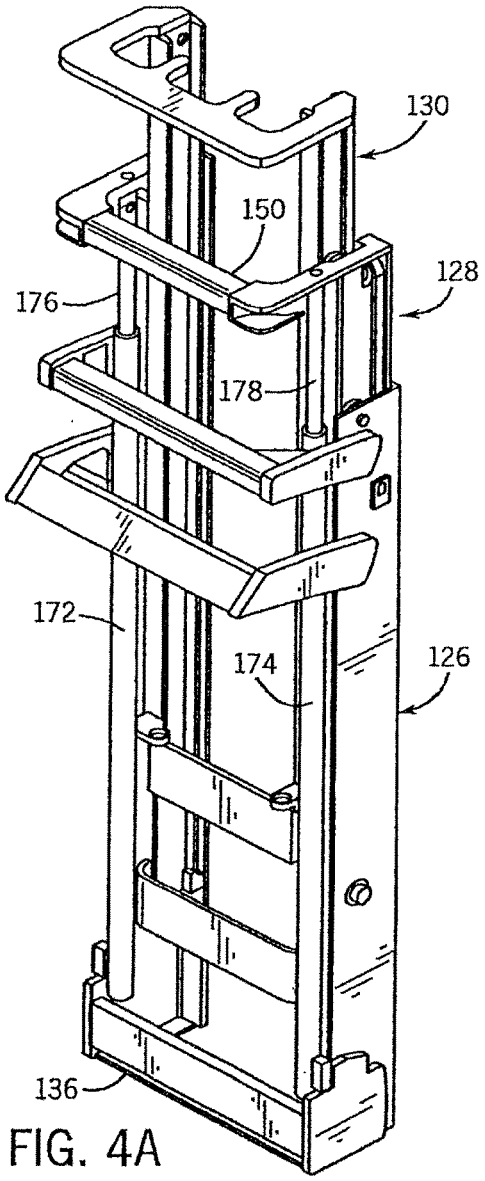
FIGS. 4A and 4B are perspective views of the mast structure of the lift truck of FIG. 3.
Figure 4B:
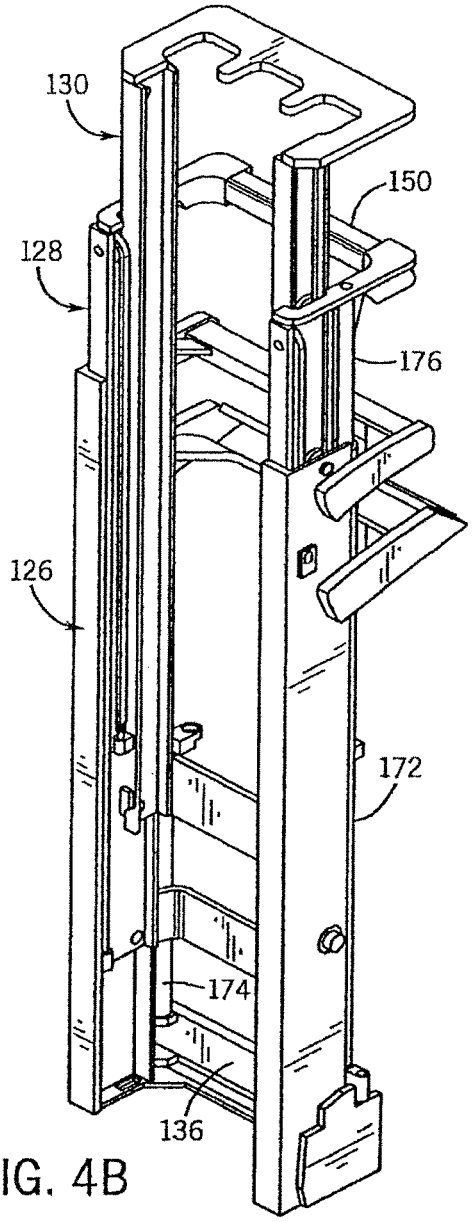

As shown best in FIGS. 4A and 4B, the telescopic mast structure is raised and lowered by a pair of main lift cylinders 172 and 174. The lower ends of the cylinders 172 and 174 are fastened to the base section 126 adjacent each end of base crosstie 136. Rods 176 and 178 extend upward from respective main lift cylinders 172 and 174 and fasten to the upper crosstie 150 on outer telescopic section 128. When the lift cylinders 172 and 174 are hydraulically operated in response to commands from the operator, the outer telescopic section 128 is lifted and lowered with respect to the base section 126 to extend and retract the mast.

As shown best in FIG. 5B, the telescopic motion of the outer telescopic section 128 in response to operation of the main lift cylinders 172 and 174 also operates the inner telescopic section 130 through a pair of lift chains 180 and 182. The lift chains 180 and 182 are supported by pulleys 184 and 186 mounted at the upper ends of respective mid rails 144 and 146 with their axes of rotation oriented in the fore and aft direction. An outboard end 188 of each lift chain 180 and 182 is connected to the inner telescopic section 130, and an inboard end 190 of each lift chain 180 and 182 is connected to the base section 126. When the outer telescopic section 128 is telescoped upward by the main lift cylinders 172 and 174, the pulleys 184 and 186 are lifted upward therewith, and the outboard ends 188 of the lift chains 180 and 182 also lift, or telescope upward to lift the inner telescopic section 130. Thus, the inner and outer telescopic sections 130 and 128 slide in unison when the main lift cylinders 172 and 174 are operated to extend or retract the mast.

Figure 6:
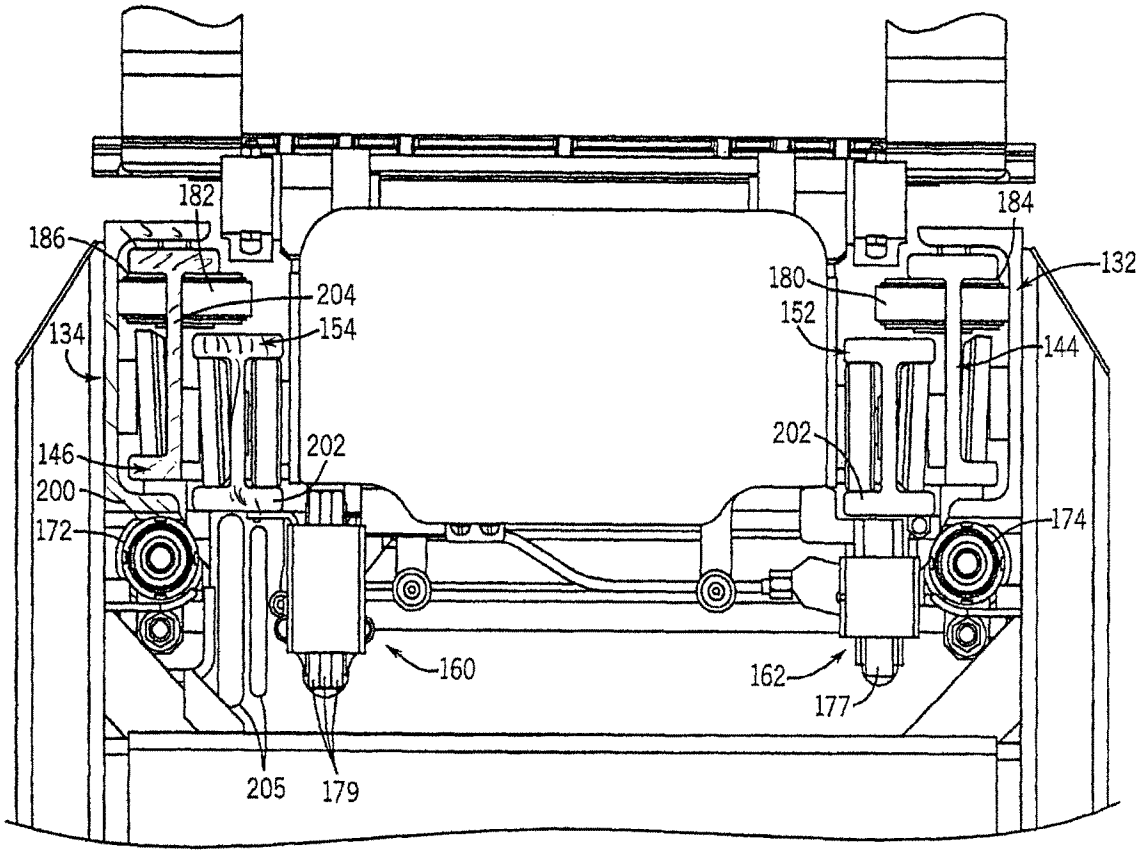
FIG. 6 is a partial top plan view of the lift truck of FIG. 3 showing the arrangement of mast elements according to a preferred embodiment of the invention.

Referring particularly to FIG. 6, the shape and location of the above mast assembly elements are designed to maximize the operator's field of view when looking forward through the mast. Looking at the left mast column, the C-shaped base rail 134 formed by a web and forward and rear flanges substantially encloses the I-shaped mid rail 146 which nests therein. The I-shaped mid rail 146 has a web with a forward and rear flange. The I-shaped top rail 154 formed by a web and forward and rear flanges is immediately inboard the base rail 134 with their respective rear flanges 200 and 202 substantially aligned. The lift chain pulley 186 is mounted in the web 204 of the mid rail 146 and it is disposed forward of the top rail 154. The resulting assembly of mast elements is compact in the lateral direction without lengthening the truck in the fore/aft direction. The right side of the mast is a mirror image of the left side, although other elements now to be described are not necessarily symmetrically arranged. In addition to the compact arrangement of elements, the left and right mast columns provide protection for the lift chains 180 and 182.

Referring still to FIG. 6, other elements of the mast are also arranged to maximize the operator's field of view. The main lift cylinders 172 and 174 are positioned directly behind the respective base rails 134 and 132. By using two main lift cylinders 172 and 174 rather than one, their diameters may be reduced such that they do not significantly increase truck length when moved behind the mast. The right side free lift cylinder 162 is positioned directly behind the top rail 152 so as not to increase the lateral dimension of the right mast column. On the other hand, the left side free lift cylinder 160 is positioned behind and inboard the rear flange 202 of the top rail 154. This arrangement allows the free lift cylinder 160 to be moved forward approximately 0.25 inches so that the much larger hose pulley 181 that supports the hoses and cable 179 can be moved forward into the viewing "shadow" of the left mast column.

Another asymmetry between the left mast column and right mast column is a set of hose pulleys 205 disposed behind the left mast column, between the main lift cylinder 172 and the free lift cylinder 160. As shown in FIGS. 5B and 6, these pulleys 205 are mounted to a support bracket 207 that extends downward from the upper crosstie 150 on outer telescopic section 128. The hoses which these pulleys 205 support hang down through the extended height of the outer telescopic and are positioned laterally in the viewing shadow of the left mast column so as to not provide an additional obstruction to the operator's field of view. As will be explained below, this asymmetric arrangement of the left and right mast columns provides a maximum field of view for an operator who is positioned to the right of the central fore and aft axis 208 of the lift truck shown in FIG. 7.

Figure 7:
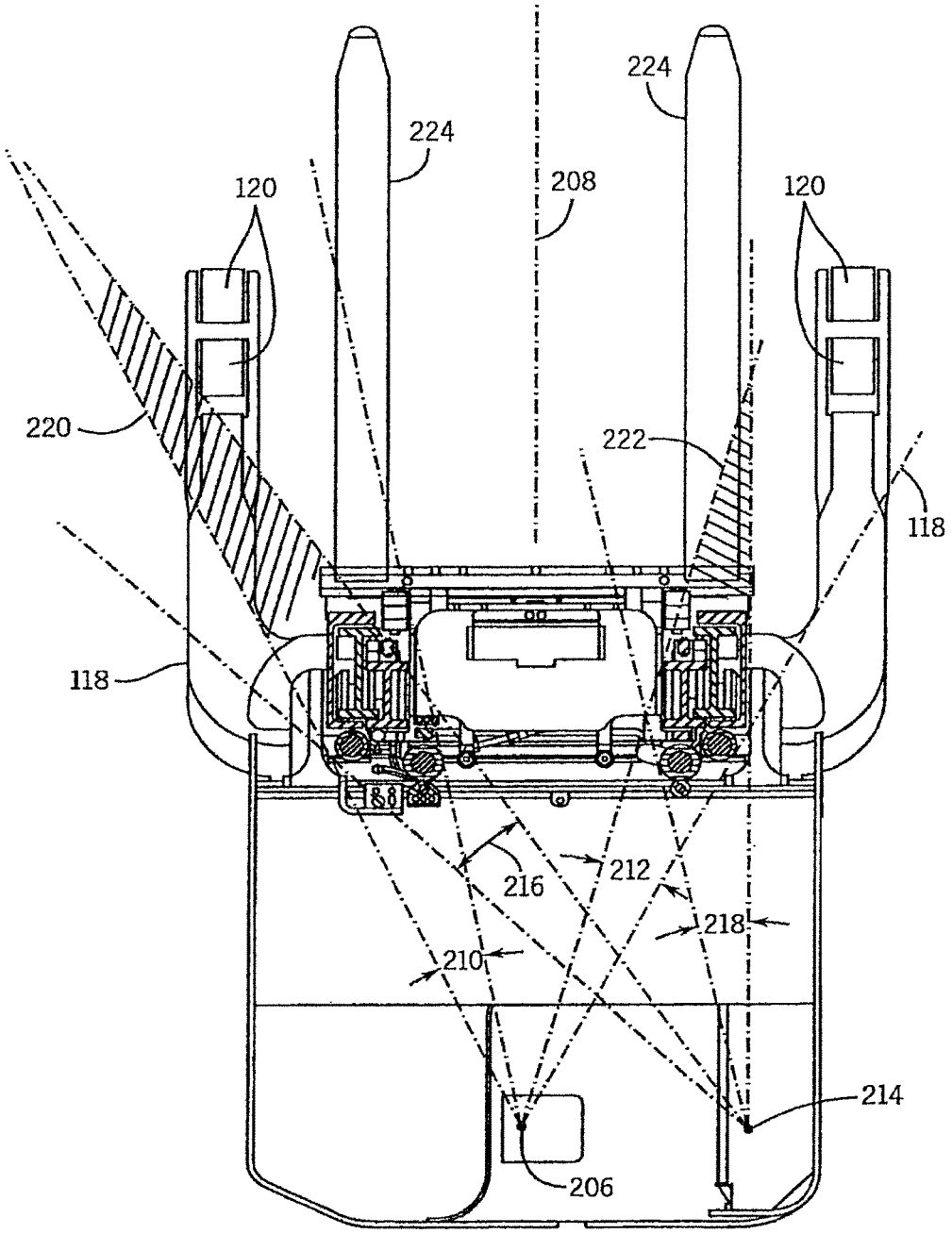
FIG. 7 is a top view of the lift truck of FIG. 3 with sight lines indicating the operator's field of view through the mast structure.

Referring particularly to FIG. 7, an operator positioned in the operator's compartment can assume a number of different positions which provide different fields of view when looking forward through the mast. When the operator takes a centered forward stance his field of view emanates from point 206 which is located near the fore and aft central axis 208 of the lift truck. Two regions 210 and 212 are blocked from view by the left and right mast columns when the operator is in this position.

The operator can also take a right forward position, in which his field of view emanates from a point 214 far to the right of the central axis 208. Two regions 216 and 218 are blocked from view by the left and right mast columns when the operator is in this position. It should be apparent that by shifting between these two operator positions the forward field of view extends to all but two, small triangular areas 220 and 222. Most importantly, the forks 224 are in complete view as are the ends of both baselegs 118. This expanded field of view facilitates driving the truck in confined spaces and placing loads on the forks 224.

We claim:

1. A lift truck comprising:

an operator compartment;

a pair of forks extending away from said operator compartment in a forward direction;

a pair of mast columns interposed between said operator compartment and said forks, said pair of mast columns include a left mast column and a right mast column when viewed from said operator compartment; and a first hose pulley mounted directly above a free lift cylinder and supporting a hose hanging down in a viewing shadow of one of the mast columns so as not to obstruct an operator's field of view when the operator is in said operator compartment operating the lift truck.

2. The lift truck as recited in claim 1, in which at least one of said mast columns includes:

a base rail having a forward flange and a rear flange joined by a web;

a mid rail disposed inwardly toward a central axis of said lift truck extending between said mast columns, said mid rail being nested between said forward flange and rear flange of said base rail; and a top rail disposed inwardly toward the central axis of said mid rail, said top rail having a forward flange and a rear flange joined by a web, wherein said rear flange of said top rail and said rear flange of said base rail are substantially aligned.

3. The lift truck as recited in claim 2, in which said base rail is C-shaped.

4. The lift truck as recited in claim 3, in which said mid rail is I-shaped.

5. The lift truck as recited in claim 4, in which said top rail is I-shaped.

6. The lift truck as in claim 2, in which a second hose pulley is fixed to said mid rail proximal an upper end of said mid rail.

7. The lift truck as in claim 1, including a main lift cylinder disposed directly behind a base rail of said one of said mast columns.

8. The lift truck as in claim 1, wherein said free lift cylinder is disposed behind and inwardly of a top rail forming part of said one of the mast columns toward a central axis of said lift truck extending between said mast columns.

9. The lift truck as in claim 1 in which said one of the mast columns is said left mast column.

10. A lift truck comprising:

an operator compartment;

a pair of forks extending away from said operator compartment in a forward direction;

a pair of mast columns interposed between said operator compartment and said forks, said pair of mast columns include a left mast column and a right mast column when viewed from said operator compartment, at least one of said mast columns includes a base rail having a forward flange and a rear flange joined by a web, a mid rail disposed inwardly from said base rail toward a central axis of said lift truck extending between said mast columns, and a top rail disposed inwardly from said mid rail toward the central axis of said truck; and a first hose pulley mounted directly above a free lift cylinder supporting a hose supplying hydraulic fluid to a fork carriage supporting said forks, wherein said hose supplying hydraulic fluid to said fork carriage extends through a viewing shadow of one of the mast columns.

11. The lift truck as recited in claim 10, in which said mid rail is nested between said forward flange and rear flange of said base rail, and said top rail includes a forward flange and a rear flange joined by a web, wherein said rear flange of said top rail and said rear flange of said base rail are substantially aligned.

12. The lift truck as in claim 10, including a main lift cylinder disposed directly behind said base rail.

13. The lift truck as in claim 10 in which said free lift cylinder is disposed behind and inwardly of a rear flange of said top rail toward a central axis of said lift truck extending between said mast columns.

14. The lift truck as in claim 10 including a second hose pulley fixed to said mid rail proximal an upper end of said mid rail and supporting a hose hanging down in the viewing shadow of the one of the mast columns so as not to obstruct an operator's field of view when the operator is in said operator compartment operating the lift truck.

15. The lift truck as in claim 10, in which said one of the mast columns is said left column.

16. A lift truck comprising:

an operator compartment;

a pair of forks extending away from said operator compartment in a forward direction;

a pair of mast columns interposed between said operator compartment and said forks, said pair of mast columns include a left mast column and a right mast column when viewed from said operator compartment, wherein at least one of said mast columns includes a base rail having a forward flange and a rear flange joined by a web, a mid rail disposed inwardly toward a central axis of said lift truck extending between said mast columns, said mid rail being nested between said forward flange and rear flange of said base rail, and a top rail disposed inwardly toward the central axis of said mid rail, said top rail having a forward flange and a rear flange joined by a web, wherein said rear flange of said top rail and said rear flange of said base rail are substantially aligned; and a first hose pulley mounted directly above a free lift cylinder, said free lift cylinder disposed behind said rear flange of said top rail and inwardly of said rear flange of said top rail toward a central axis of said lift truck extending between said mast columns.

17. The lift truck as in claim 16, including a second hose pulley supporting a hose hanging down in a viewing shadow of one of the mast columns so as not to obstruct an operator's field of view when the operator is in said operator compartment operating the lift truck.

18. The lift truck as in claim 17, wherein said free lift cylinder is disposed behind said rear flange of said top rail and inwardly of said rear flange of said top rail toward a central axis of said lift truck extending between said mast columns.

19. The lift truck as in claim 18, wherein said first hose pulley is supporting a hose supplying hydraulic fluid to a fork carriage supporting said forks, wherein said hose supplying hydraulic fluid to said fork carriage extends through the viewing shadow of the left mast column.

* * * * *